United States Patent [19]

Trifunovic et al.

[11] 4,069,564

[45] Jan. 24, 1978

[54] PROCESS FOR PRODUCING INTERLACED OR ENTANGLED MULTIFILAMENT YARNS

[75] Inventors: Alexander L. Trifunovic, Burlington; James Irvin Combs, Gibsonville, both of N.C.

[73] Assignee: Glen Raven Mills, Inc., Glen Raven, N.C.

[21] Appl. No.: 740,852

[22] Filed: Nov. 3, 1976

Related U.S. Application Data

[62] Division of Ser. No. 700,072, June 28, 1976.

[51] Int. Cl.[2] ..... D02G 1/16

[52] U.S. Cl. ..... 28/273

[58] Field of Search ..... 28/1.3, 1.4, 72.11, 28/72.12, 271, 273

[56] References Cited

U.S. PATENT DOCUMENTS

| | | | |
|---|---|---|---|
| 2,982,000 | 5/1961 | Gonsalves | 28/1.4 |
| 3,036,357 | 5/1962 | Cook et al. | 28/72.12 X |
| 3,805,343 | 4/1974 | Ethridge | 28/1.4 |
| 3,874,044 | 4/1975 | Kwon et al. | 28/1.3 |
| 3,911,655 | 10/1975 | London, Jr. et al. | 28/72.12 X |
| 3,916,493 | 11/1975 | Ethridge | 28/1.4 |
| 3,977,059 | 8/1976 | Ethridge et al. | 28/72.12 X |

FOREIGN PATENT DOCUMENTS

| | | | |
|---|---|---|---|
| 2,116,718 | 1/1972 | Germany | 28/271 |
| 47-36,204 | 9/1972 | Japan | 28/273 |

*Primary Examiner*—Mervin Stein
*Assistant Examiner*—Andrew Falik
*Attorney, Agent, or Firm*—Mason, Fenwick & Lawrence

[57] ABSTRACT

A method for interlacing or entangling continuous multifilament synthetic yarn wherein the yarn to be interlaced is fed along a feed path through a yarn feed bore to a jet nozzle member defining with a surrounding housing and an outlet tube member a shaped turbulence chamber within the housing at the exit of the yarn feed bore in the nozzle member. The jet nozzle member has one or more jet passages directing fluid from a pressurized air chamber into the turbulence chamber along jet axes inclined to the yarn feed axis and offset sidewise in non-intersecting relation thereto to produce interlocking entanglements of filaments of the yarn during passage therethrough.

2 Claims, 8 Drawing Figures

Fig-3
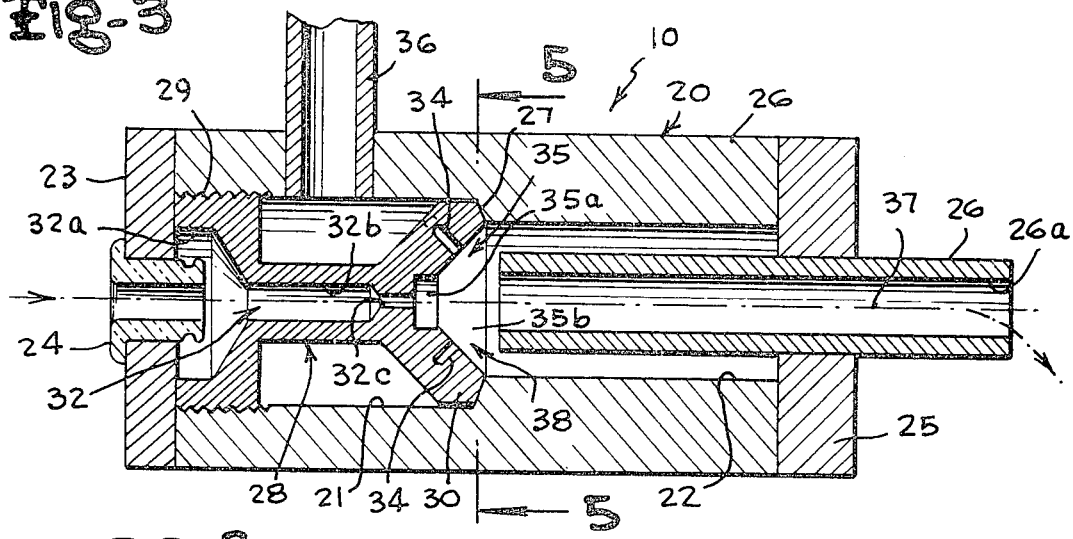
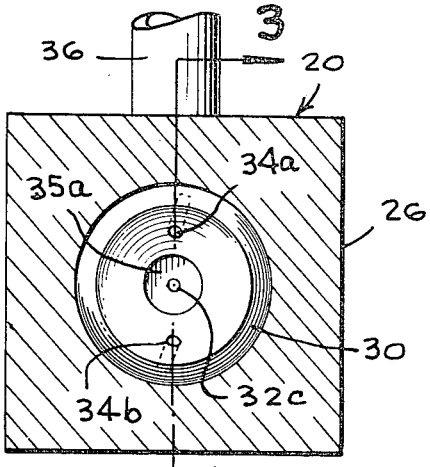
Fig-5
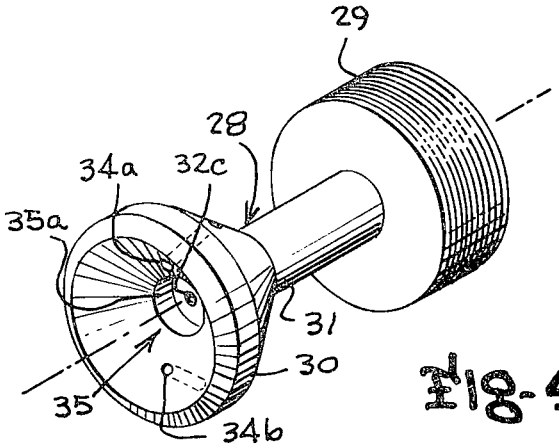
Fig-4
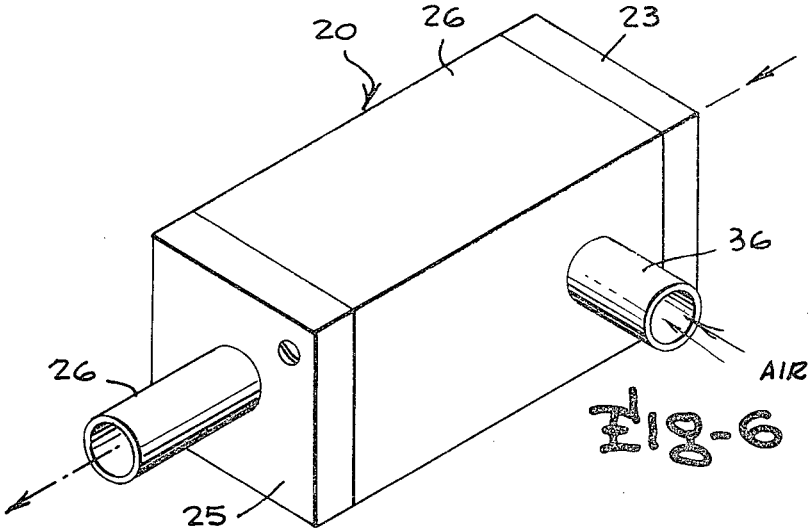
Fig-6

PROCESS FOR PRODUCING INTERLACED OR ENTANGLED MULTIFILAMENT YARNS

This application is a division of our earlier application Ser. No. 700,072 filed June 28, 1976.

BACKGROUND AND OBJECTS OF THE INVENTION

The present invention relates in general to the production of interlaced or entangled multifilament yarns, and more particularly to methods for producing interlaced or entangled continuous multifilament synthetic yarn by impinging fluid streams or fluid jets on the yarn to impart entanglement thereto.

Heretofore, various methods have been used in the textile industry for producing a coherent yarn from a plurality of single-end, continuous, multifilament yarns by processes such as twisting, sizing, entangling, crimping, and the like. It is important to cohere together the filaments of multifilament yarns or to cohere yarns formed of two or more ends wound on a package, to improve the handling of the yarn in various textile operations and to keep the yarn together at all times during unwinding. It is a common occurrence that combinations of two or more yarn ends, when unwound, without having been twisted in advance, will cause problems which will result in machine stoppage and/or defective fabric with great frequency. Because of the difficulty in handling of yarn which has not been rendered properly coherent, it was customary for a long time to subject the yarn to the additional step of twisting each yarn, which served to compact and unify a yarn bundle resulting in a more cohesive structure which resists the pulling out of individual filaments. However, conventional true twisting was expensive and time consuming, and being a discontinuous operation, added disproportionately to the cost of the yarn. Also, the mechanics of true twisting and the additional handling required often resulted in yarn of lower quality.

More recently, processes have been adopted involving subjecting the yarn to high velocity fluid jets, generally created by compressed air, designed to have the capability of imparting entanglement or other different treatments to the yarn. Generally, such jets when used to produce entanglements, or what has been called "interlaced" yarn, have frequently been directed in a plane that is substantially normal to the direction in which the yarn advances, and in some cases have been directed along an axis inclined convergently to the yarn feed axis in the direction of yarn travel but intersecting the center of the yarn feed axis. It is of course, generally known that one single fluid jet design is incapable of producing all of the required yarn configurations and each fluid jet design is therefore limited to production, in general, of only one yarn type, such as a yarn type containing a large number of loops, or a yarn type providing slightly intermingled yarn filaments but producing no large or small loops.

An object of the present invention, therefore, is the provision of a novel method whereby two or more continuous synthetic multifilament yarns can be interlaced or entangled together continuously or at intervals with entanglement spacings positioned at random or fairly uniform distances as desired.

Another object of the present invention is the provision of a novel method for applying to filament yarns the force of suitable fluid jets, such as jets of compressed air or the like, in certain configurations and directions resulting in yarn interlacing providing a coherent yarn which will unwind from a yarn package without possibility of separation during further processing.

Another object of the present invention is the provision of a novel method for effecting intermittent or coherent entanglement to already bulked multifilament yarn by directing fluid jets of compressed air or the like against the yarn moving along a feed path and directed along jet axes which pass slightly to opposite sides of the center axis of the feed path so as not to intersect the center axis of the yarn feed path, to impart entanglement to the multifilament yarn permitting unwinding from a yarn package without separation of the yarn ends during further processing.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 3 is a vertical section view through yarn entangling jet apparatus embodying the present invention;

FIG. 4 is a perspective view of the air nozzle component of the yarn entangling jet apparatus;

FIG. 5 is a vertical transverse section view to enlarged scale showing the location and disposition of the jet orifices in the nozzle component, taken along the line 5—5 of FIG. 3;

FIG. 6 is a perspective view of the exterior of the yarn entangling jet apparatus of the present invention;

DETAILED DESCRIPTION OF PREFERRED EMBODIMENTS

Figure 1:
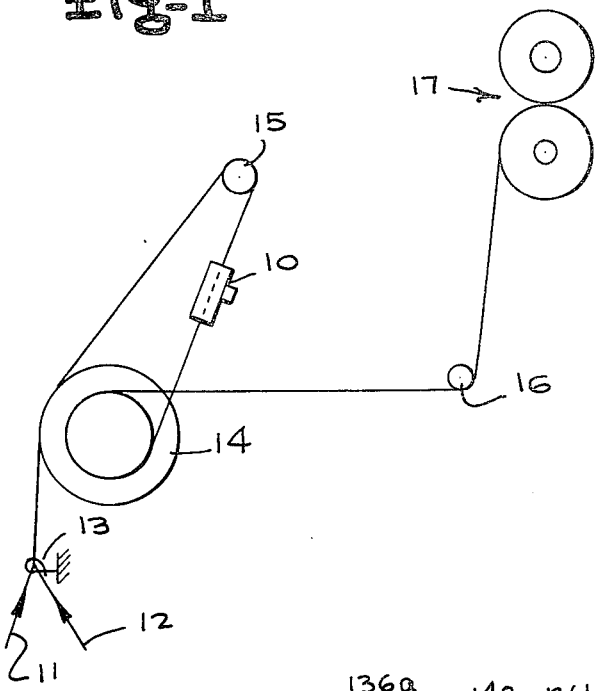
FIG. 1 is a diagrammatic view of a yarn winder incorporating the yarn interlacing jet of the present invention.
Figure 2:
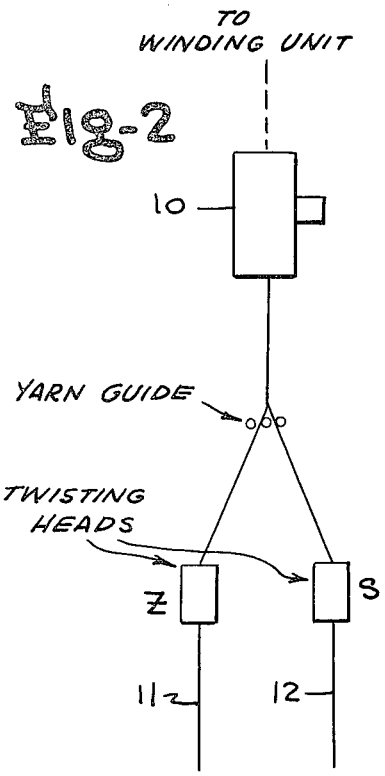
FIG. 2 is a diagrammatic view of a false twist yarn texturizer incorporating the interlacing jet.

The method of the present invention involves use of a yarn interlacing or entangling jet device, indicated generally by the reference character 10, designed to be interposed in the yarn feed path, along which a plurality of two or more continuous synthetic multifilament yarns are being fed in a processing line. For example, the interlacing jet device may be incorporated in a winding operation or at a false twist machine, to receive plural continuous multifilament synthetic yarn, such as two ends of 70 denier yarn to be entangled or interlaced at the jet apparatus, with the yarn being supplied to the jet device with a small percentage of yarn overfeed. When used in association with a winder and two ends of yarn, such as 70 denier continuous multifilament synthetic yarn, two ends of yarn indicated at 11 and 12 in FIG. 1, which may be already bulked or texturized, and may be two ends of S and Z twist, or two S twist, or two Z twist, yarns, may be brought together through a yarn guide 13 from supply packages and fed about overfeed rolls 14 through a plurality of courses or wraps about the overfeed rolls and guide bar or roll 15, with the yarn passing through the jet apparatus 10 during passage to the overfeed roll section 14 and thence passing about guide 16 to the winder head 17 to form a wound package of the interlaced yarn. Likewise the yarn entangling jet apparatus 10 may be interposed in a yarn processing line, such as on a false twist machine, as shown in FIG. 2, to receive the joined two ends of S and Z type yarn after their passage through S and Z twisting heads and the yarn guide before passage to the winding unit during texturizing.

A preferred embodiment of the structure for the yarn entangling apparatus 10 is illustrated in FIGS. 3, 4 and 5 and comprises a main body 20, made for example of steel or other metal, which in the illustrated embodiment forms a housing of rectangular exterior configuration, although it will be appreciated that the main body 20 may be a cylindrical tubular member if desired. In the illustrated embodiment, the main body 20 is provided with a larger diameter cylindrical bore portion 21 extending from the upstream or inlet end of the body 20 to the midregion thereof and communicating with a smaller diameter cylindrical bore portion 22 extending to the outlet or downstream end of the main body. The inlet end is closed by an inlet plate 23 having an aperture fitted with a yarn infeed eyelet, such as porcelain eyelet 24, through which the yarns are fed to the interior of the main body 20. The downstream or outlet end of the main body is closed by end plate 25 having an aperture in which is fixed an axially elongated hollow cylindrical tubular tunnel member 26 having a bore **26*a* extending therethrough of uniform diameter along the full axial length of the tunnel member 26. The larger diameter bore portion 21 joins the smaller diameter bore portion 22 in the midregion of the body 20 by a conical transition surface forming a transition wall 27 converging toward the downstream or outlet end of the body 20**.

Within the larger diameter bore portion 21 is a nozzle member 28 having an enlarged head portion 29 at the upstream end and an enlarged orifice head portion 30 at its downstream end, and having a constricted or smaller diameter midportion 31. A yarn passage or bore 32 extends through the axial length of the nozzle member 28 and comprises, in the illustrated embodiment, a larger diameter inlet bore portion **32*a* and a smaller diameter intermediate bore portion 32*b*, and a still smaller diameter outlet bore portion 32*c*. The transition wall between the smaller diameter midportion 31 of the nozzle member and the larger diameter orifice head 30 in the illustrated embodiment is of annular truncated conical configuration diverging relative to the axis of the bore 32 in a downstream direction and the outer rim portion of the orifice head 30 confronting the interior transition wall 27 of the body 20 is shaped to conform to and butt tightly against the annular truncated conical surface 27. Also, the transition surface between the bore portions 32*a*, 32*b* and 32*c* of the nozzle member 28 are each of an annular truncated conical configuration in the illustrated embodiment, converging toward the downstream end of the device 10**.

A plurality of jet passages or orifices 34, two of such orifices being provided in the illustrated embodiment of FIGS. 3–5, extend along axes inclined inwardly toward the yarn path and toward the downstream end of the body 20 but are precisely located in offset relation to the axis of the yarn so that the extension of the air jet passages 34 are spaced a short distance to opposite sides of the yarn feed axis 37. The smaller diameter bore portion **32*c* of the nozzle member 28 opens into an enlarged outlet chamber formation 35 coacting with the adjoining portion of the smaller diameter bore 22 in the body 20 and the adjacent portions of the tunnel member 26 to form a turbulence chamber 38 for the yarn. The outlet chamber 35 is shaped, in the illustrated embodiment, to define a first upstream chamber portion 35*a* of generally cylindrical configuration having a larger diameter than the diameter of the yarn passage section 32*c* which then joins a truncated conical chamber section 35*b* extending to the downstream end of the nozzle member 28 and diverging outwardly from the yarn path to a diameter approximating the diameter of the bore portion 22**.

The smaller diameter midportion 31 of the nozzle member 28 defines within the bore 21 an annular chamber to which pressurized fluid, for example air under pressure of about 15 pounds per square inch, is supplied through an inlet opening 36.

In one satisfactory embodiment, the enlarged head portion 29 of the nozzle member 28 is threaded at its outer periphery to be coupled with threads along the wall of the bore 21 at the upstream end of the bore 21 to facilitate removal and replacement of the nozzle member 28. Thus the nozzle member 28 may be readily removed for cleaning, repair or replacement by removing the inlet end plate and threading the nozzle member 28 out of the bore 21. Also, other nozzle members shaped like the nozzle member 28 but having different numbers of inclined air passages 34 such as three, four or five air passages, may be readily substituted for the nozzle member 28 having the two air passages 34 as described above, by simply removing the end plate 23 and rotating the nozzle members to back the nozzle member out of the bore 21 and insert another one.

In one satisfactory example, the nozzle member 28 has an overall axial length from the upstream end of head portion 29 to the exit edge of the outlet chamber 35 of about 0.950 inches (24.130 mm) and a diameter of about 0.500 inches (12.700 mm) at the heads 29 and 30. The diameter of the constricted midportion 31 of the nozzle member 28 in this example is about 0.320 inches (8.128 mm) and its axial length is about 0.510 inches (12.954 mm), the upstream conical surface of the orifice head flaring outwardly at an angle of about 45° to the yarn feed axis 37. The inlet bore portion **32*a* has an axial length of about 0.200 inches (5.080 mm) and a diameter of about 0.375 inches (9.525 mm), the intermediate bore portion 32*b* has an axial length of about 0.500 inches (12.700 mm) and a diameter of about 0.125 inches (3.175 mm), and the outlet bore portion 32*c* has an axial length of about 0.130 inches (3.302 mm) and a smaller diameter than the intermediate bore portion 32*b*. In this example, the cylindrical portion 35*a* of outlet chamber 35 has a diameter of about 0.155 inches (3.937 mm) and an axial length of about 0.068 inches (1.727 mm), the conical portion 35*b* has an axial length of about 0.095 inches (2.413 mm) and flares outwardly at a 45° angle to a maximum diameter of about 0.275 inches (6.985 mm) at its outlet edge, and the air passages 34 are two in number having a diameter of about 0.062 inches (1.575 mm) and axial length of about 0.082 inches (2.083 mm) and their extended center axes are spaced about ± 1 mm to opposite sides of the yarn feed axis 37**.

The jet entangling device described above has been found to produce satisfactory results to provide entangled or interlaced yarn formed of two ends of 70-denier yarn, with a turbulence chamber having the dimensions described in the preceding paragraph and having air passages 34 of the dimensions given above, with an air pressure of about 15 pounds per square inch supplied to the air-inlet opening 36, the yarn fed at a yarn speed of about 150 yards per minute with a yarn overfeed of 4 percent, and the jet passages 34 inclined at about a 45° angle to the axis of the yarn being fed through the yarn passage 32 and the extended center axes of the air passages 34*a* and 34*b* spaced respectively to the left and right of the yarn axis by a slight distance, for example, of about 1 mm. In this example, the entanglement spacing produced averages about 6 entanglements per inch. With the particular construction described, the fluid jet device permits using air pressure and air volume per minute as low as possible while achieving very good yarn entanglement or interlacing. It is believed that the coactive effect of the inclined, slightly laterally spaced or offset air jet passages, together with the configuration and size of the turbulence chamber achieves a significant fluid turbulence in the chamber which activates a certain harmonic resonance in the yarn and, coupled with the yarn overfeed of a chosen percentage, achieves reliable entanglement or interlacing of the yarn filaments. By varying the nozzle angle, and the position of the tunnel-forming tube 26, as well as the size of the turbulence chamber, a closer or more distantly spread entanglement for interlacing of the yarn can be achieved. Further variations may be achieved by increasing the number of the air jet passages 34 in the nozzle member 28, up to as many as 5 inclined and offset air passages if desired, and even more effective and closer entanglement of the filaments can be achieved by using a tandem nozzle construction providing a succession of two nozzle members as illustrated in FIG. 7.

Figure 7:
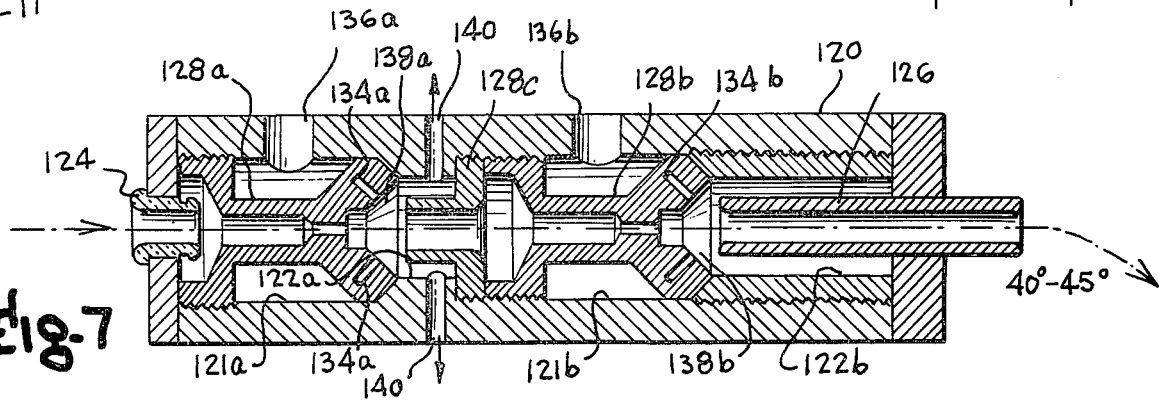
FIG. 7 is a longitudinal section view of another form of the yarn entangling jet apparatus having a plurality of fluid jet nozzles arranged serially along the yarn path.

Referring to FIG. 7, there is illustrated a housing 120 similar to the body or housing 20 of the previously described embodiment, having a first stage larger bore portion 121*a* and a smaller first stage bore portion 122*a*, as well as second stage larger bore portion 121*b* and second stage smaller bore portion 122*b*, similar to bore portions 21 and 22 of the first described embodiment. A yarn infeed eyelet 124 is provided at the upstream or feed end of the device through which the yarn is fed into the bore sections of the first stage nozzle member 128*a* like the nozzle member 28 of the first embodiment, and spaced toward the downstream or discharge end of the housing is a second stage nozzle member 128*b* similar to the nozzle member 128*a*, but having a member 128*c* abutting the upstream end of the second stage nozzle member 128*b* and defining an annular tubular formation similar in cross-sectional configuration and size to the tubular tunnel member 26, defining the downstream portion of the first stage turbulence chamber 138*a*. Pressurized air admitted through the air inlet 136*a* into the chamber surrounding the constricted portion of the first stage nozzle member 128*a* is formed into a jet directed through the inclined air passages 134*a* like the air passages 34 of the first embodiment, and pressurized air, if desired from the same source, is admitted through second stage air inlet 136*b* into the chamber surrounding the second stage nozzle member 128*b* and is formed into air jets by air passage 134*b* in the second stage nozzle member to achieve further interlacing or entanglement of the yarn in the second stage turbulence chamber 138*b*, after which the yarn passes through the outlet tunnel member 126 similar to the tunnel member 26 of the first embodiment. Air exit passages 140 extend radially outwardly from bore portion 122*a* to release pressure in the chamber 138*a* to the exterior of the housing 120.

Figure 8:
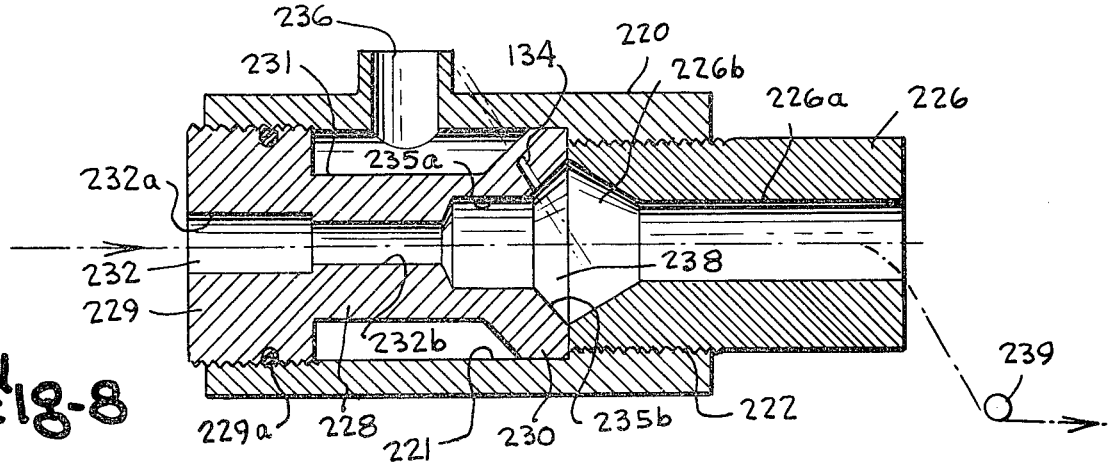
FIG. 8 is a longitudinal section view of another form of the yarn entangling jet devices.

Yet another form of apparatus for satisfactorily effecting interlacing or entanglement of the multifilament yarn is illustrated in FIG. 8, wherein the outer housing member is indicated by the reference character 220 and provides a lateral air inlet opening 236 and a bore formed of an upstream larger bore portion 221 and a downstream smaller bore portion 222. Within the upstream larger bore portion 221 is a nozzle member 228 similar to the nozzle member 28 of the first embodiment, having an enlarged upstream head 229, which may be threaded into threads provided in the inwardly facing surface of the bore 221 to seat the nozzle member 228 within the bore, and is additionally provided with a rubber O-ring or similar sealing ring 229*a* provided in a channel in the outer perimeter of the enlarged head 229 to seal the interface zone between the head 229 and the confronting portion of the bore 221. The nozzle member 228 is provided with a smaller diameter midportion 231 and an orifice head 230, and with a yarn bore having a larger diameter inlet bore portion 232*a* and a smaller diameter bore portion 232*b*, the latter of which opens into a turbulence chamber 238 defined by a cylindrical upstream chamber portion 235*a* and a truncated conical chamber section 235*b* in the orifice head 230, similar to chamber sections 35*a* and 35*b* of the first embodiment, which communicate with a truncated conical chamber portion 226*b* converging to and merging into the tunnel member bore portion 226*a* of the tunnel member 226. The tunnel member 226 is threaded into and therefore axially adjustable relative to the smaller diameter bore portion 222 of the housing and forms, in effect, a node adjustor tube by which variation in the number of interlacings or entanglements per inch can be varied, while the chamber portions 235*a*, 235*b* and 235*c* coact to form the turbulence-vortex chamber. In this embodiment, only one air passage or air injector hole 134 is provided, which in a satisfactory embodiment has a diameter of about 0.062 inch and is oriented so that its extended center axis is slightly offset from the center axis of the yarn being fed through the apparatus and extended along an angle within the range of 30° to 75° to the yarn feed axis, for example, at about 45°. It will be noted that in this embodiment as well as in the preceding embodiment, the yarn is deflected downwardly or away from the rectilinear yarn path defined by the yarn passages in the members 228 and 226, for example by means of a yarn deflecting rod 239 shown in FIG. 8, so that the yarn path exits from the yarn outlet opening or bore 226*a* of the tubular member 226 in a direction inclined away from the extended axis of the bore 226*a*.

We claim:

1. A process for interlacing or entangling plural ends of continuous multifilament synthetic yarn being fed along a feed path by impinging pressurized fluid jets on the yarn to produce repeating sections lengthwise of the yarn having a plurality of interlocking entanglements per inch occurring along the length of the treated yarn, comprising the steps of feeding the plural yarn ends with an overfeed within the range of about three to twenty percent through a rectilinear yarn feed passage of a predetermined diameter concentric with a yarn feed axis to direct the path of the yarn along the yarn feed axis through the feed passage, feeding the yarn from said passage directly into a turbulence chamber concentric with the feed axis formed of a first cylindrical turbulence chamber section at its upstream end of larger diameter than the adjoining feed passage portion and a second truncated conical turbulence chamber section serially arranged immediately downstream of the first chamber section communicating therewith and having a conical boundary surface enlarging in a downstream direction to a greater diameter than the first chamber section and several times the feed passage diameter and thence feeding the yarn from said turbulence chamber through an axially elongated cylindrical outlet passage concentric with the feed axis of smaller diameter than the maximum diameter of the turbulence chamber, and concurrently directing continuous jets of air under superatmospheric source pressure of about 7 to 30 psi into the turbulence chamber through jet orifices located in said conical boundary surface of the second chamber section and spaced radially inwardly from the largest diameter portion of the chamber to impinge on the yarn being fed therethrough and blow the filaments into interlaced condition without formation of loops, the jets extending along paths within the turbulence chamber which are of small cross section relative to the cross-sectional size of the chamber with the jets convergently angling downstream toward the yarn axis along jet axes which pass in laterally offset spaced non-intersecting relation alongside the yarn axis.

2. A process for interlacing or entangling plural ends of continuous multifilament synthetic yarn being fed along a feed path by impinging pressurized fluid jets on the yarn to produce repeating sections lengthwise of the yarn having a plurality of interlocking entanglements per inch occurring along the length of the treated yarn, comprising the steps of feeding the plural yarn ends with an overfeed within the range of about three to twenty percent through a rectilinear yarn feed passage of a predetermined diameter concentric with a yarn feed axis to direct the path of the yarn along the yarn feed axis through the feed passage, feeding the yarn from said passage directly into a turbulence chamber concentric with the feed axis formed of a first cylindrical turbulence chamber section at its upstream end of larger diameter than the adjoining feed passage portion and a second truncated conical turbulence chamber section serially arranged immediately downstream of the first chamber section communicating therewith and having a conical boundary surface enlarging in a downstream direction to a greater diameter than the first chamber section and several times the feed passage diameter and thence feeding the yarn from said turbulence chamber through an axially elongated cylindrical outer passage concentric with the feed axis of smaller diameter than the maximum diameter of the turbulence chamber, and concurrently directing a continuous jet of air under superatmospheric source pressure of about 7 to 30 psi into the turbulence chamber through a jet orifice located in said conical boundary surface of the second chamber section and spaced radially inwardly from the largest diameter portion of the chamber to impinge on the yarn being fed therethrough and blow the filaments into interlaced condition without formation of loops, the jet extending along a path within the turbulence chamber which is of small cross section relative to the cross-sectional size of the chamber with the jet convergently angling downstream toward the yarn axis along a jet axis which passes in laterally offset spaced nonintersecting relation alongside the yarn axis.

* * * * *